US005769757A

United States Patent [19]

Fulks

[11] Patent Number: 5,769,757

[45] Date of Patent: Jun. 23, 1998

[54] METHOD AND APPARATUS FOR EXERCISE WITH FORCED PRONATION OR SUPINATION

[76] Inventor: Kent Fulks, 9710 Amberly Dr., Dallas, Tex. 75243

[21] Appl. No.: 667,428

[22] Filed: Jun. 21, 1996

[51] Int. Cl.[6] ..... A63B 23/12; A63B 21/08

[52] U.S. Cl. ..... 482/45; 482/97; 482/137

[58] Field of Search ..... 482/45, 46, 97, 482/139, 134–137, 44; 601/40

[56] References Cited

U.S. PATENT DOCUMENTS

| | | |
|---|---|---|
| 2,855,199 | 10/1958 | Noland et al. . |
| 3,056,895 | 10/1962 | Cohen et al. . |
| 3,306,611 | 2/1967 | Gaul . |
| 3,366,903 | 1/1968 | Searle et al. . |
| 3,640,527 | 2/1972 | Proctor . |
| 3,848,467 | 11/1974 | Flavell . |
| 3,869,121 | 3/1975 | Flavell . |
| 3,874,659 | 4/1975 | Aharoni . |
| 3,902,480 | 9/1975 | Wilson . |
| 3,998,100 | 12/1976 | Pizatella et al. . |
| 4,063,726 | 12/1977 | Wilson . |
| 4,082,267 | 4/1978 | Flavell . |
| 4,138,106 | 2/1979 | Bradley . |
| 4,184,678 | 1/1980 | Flavell et al. . |
| 4,235,437 | 11/1980 | Ruis . |
| 4,253,662 | 3/1981 | Podolak . |
| 4,261,562 | 4/1981 | Flavell . |
| 4,323,237 | 4/1982 | Jungerwirth . |
| 4,337,050 | 6/1982 | Engalitcheff, Jr. . |
| 4,354,676 | 10/1982 | Ariel . |
| 4,355,633 | 10/1982 | Heilbrun . |
| 4,358,695 | 11/1982 | MacDonald et al. . |
| 4,411,424 | 10/1983 | Barnett ..... 482/139 |
| 4,422,636 | 12/1983 | De Angeli . |
| 4,461,475 | 7/1984 | Nakamura . |
| 4,518,163 | 5/1985 | Bruder . |
| 4,569,518 | 2/1986 | Fulks . |
| 4,600,189 | 7/1986 | Olschansky et al. . |
| 4,616,825 | 10/1986 | Anderson . |
| 4,621,807 | 11/1986 | Stramer . |
| 4,621,810 | 11/1986 | Cummins . |
| 4,623,144 | 11/1986 | Rockwell . |
| 4,627,614 | 12/1986 | De Angeli . |
| 4,629,185 | 12/1986 | Amann . |
| 4,634,118 | 1/1987 | Jensen . |
| 4,666,149 | 5/1987 | Olschansky et al. . |
| 4,711,448 | 12/1987 | Minkow et al. . |
| 4,721,303 | 1/1988 | Fitzpatrick . |
| 4,726,582 | 2/1988 | Fulks . |
| 4,744,559 | 5/1988 | Mahnke et al. . |
| 4,746,115 | 5/1988 | Lahman . |
| 4,765,615 | 8/1988 | Case . |
| 4,768,775 | 9/1988 | Marshall . |
| 4,809,972 | 3/1989 | Rasmussen et al. . |
| 4,844,456 | 7/1989 | Habing et al. . |
| 4,854,578 | 8/1989 | Fulks . |
| 4,898,381 | 2/1990 | Gordon . |

(List continued on next page.)

FOREIGN PATENT DOCUMENTS

WO 93/04738 3/1993 WIPO .

*Primary Examiner*—Richard J. Apley
*Assistant Examiner*—Victor Hwang
*Attorney, Agent, or Firm*—John F. Bryan

[57] ABSTRACT

An exercise device includes forced pronation or supination movement of the hand and arms in conjunction with the standard range of motion for a specified exercise. The device comprises a conventional frame and a centrally mounted seat. Pivotally attached to the frame is a sub-frame including a pair of levers that pivot in tandem about a horizontal first axis of rotation A1 and movably attached to the distal end of each lever is a double "L" shaped handle that includes a grip that pivots about a second axis of rotation A2. A2 is is substantially perpendicular to A1 and the distal end of the second leg of the double "L" shaped handle is movably attached with a ball and socket connection to a first end of a linkage rod. The second end of the linkage rod is movably attached with a second ball and socket connector to the frame so that, as the levers pivot about axis A1, each handle is forced to pivot about its axis A2 in a predetermined relationship with the position of the levers.

12 Claims, 5 Drawing Sheets

U.S. PATENT DOCUMENTS

| | | | |
|---|---|---|---|
| 4,902,006 | 2/1990 | Stallings, Jr. . | |
| 4,915,377 | 4/1990 | Malnke et al. . | |
| 4,930,768 | 6/1990 | Lapcevic . | |
| 4,964,632 | 10/1990 | Rockwell . | |
| 4,982,955 | 1/1991 | Heasley . | |
| 4,982,956 | 1/1991 | Lapcevic . | |
| 4,986,538 | 1/1991 | Ish, III . | |
| 4,988,095 | 1/1991 | Ferrari . | |
| 5,044,631 | 9/1991 | Jones . | |
| 5,074,551 | 12/1991 | Olschansky et al. . | |
| 5,135,449 | 8/1992 | Jones . | |
| 5,209,223 | 5/1993 | McGorry et al. . | |
| 5,236,406 | 8/1993 | Webber . | |
| 5,336,148 | 8/1994 | Ish, III | 482/97 |
| 5,342,270 | 8/1994 | Jones | 482/137 |
| 5,413,546 | 5/1995 | Basile | 482/137 |
| 5,417,633 | 5/1995 | Habing . | |
| 5,447,480 | 9/1995 | Fulks . | |
| 5,470,297 | 11/1995 | Park . | |
| 5,486,150 | 1/1996 | Randolph | 482/137 |
| 5,562,577 | 10/1996 | Nichols, Sr. et al. | 482/97 |

262
263
280
282
A9
267
268
252
284
285
286
288
289
290
292
A8
256
258
259

METHOD AND APPARATUS FOR EXERCISE WITH FORCED PRONATION OR SUPINATION

TECHNICAL FIELD

This invention relates generally to exercise machines and more particularly to exercise machines with forced pronation or supination movement for the hands and arms.

BACKGROUND OF THE INVENTION

Many athletes and non-athletes utilize weight lifting or weight training exercises to build strength and/or bulk, to prevent injury, or to improve overall condition and appearance. Typically, weight training exercises are performed with either exercise machines or free weights, i.e., barbells and weighted plates, dumbbells, etc. For various reasons, most exercise programs incorporate both machines and free weights in a variety of different exercise routines in order to maximize the effect of working the desired muscle groups.

Free weights offer a number of advantages over exercise machines. For instance, they are relatively inexpensive in comparison to exercise machines. Free weights are also more versatile because a variety of exercises can be performed with one set of weights, whereas most exercise machines are designed for only one exercise. Even though some exercise machines accommodate more than one exercise, the cost of these machines usually increases proportionately with the number of exercises. Use of dumbbells also enables both arms to be exercised independently. Finally, free weights are popular among many weight lifters because the lifting movements are not restricted to prescribed planes of motion or prescribed angles.

Nevertheless, there are also a number of inherent disadvantages associated with free weights. One such disadvantage relates to safety. Although most weight room instructors strongly advise against an individual working out alone, this cautionary measure is particularly important when the lifting of free weights is involved. This is due to commonly recognized dangers such as the possibility of dropping a weight on a body part, or becoming trapped beneath a bar, which could easily occur in exercises such as bench press, incline or squat. Additionally, through carelessness, loading and unloading of heavy weighted plates onto the ends of a bar sometimes results in an unbalanced bar that falls downward from its rack.

Another disadvantage associated with free weights relates to the fact that the weight resistance, or opposing force, that is exercised against is always directed vertically downward by gravity. Yet, the moment arm of the weight about the pivot point varies considerably throughout the full range of motion. This principle is explained in U.S. Pat. No. 3,998,454 with respect to a commonly performed exercise referred to as the dumbbell bicep curl. In short, during this exercise the applied moment arm about the elbow varies according to the sine of the angle of the lower arm with respect to the vertically oriented upper arm. The moment arm is greatest when the angle is 90° and it is lowest when the angle is 180° and 0°.

If the resistance capabilities of the muscles of the human body matched this moment arm, the degree of difficulty experienced by the exerciser would be uniform, or balanced, throughout the entire range of motion. However, as reported in U.S. Pat. No. 3,998,454, the strength generated by the human muscles during this exercise is not in fact "balanced" throughout the range of motion, and there are some "sticking points" of increased difficulty. As a result, maximum benefits are not achieved when performing a bicep curl with a dumbbell.

The pullover machine disclosed in U.S. Pat. No. 3,998,454 utilizes an eccentric cam to vary weight resistance over the range of motion for the muscles utilized in a pullover maneuver. Over the years, for various muscle groups, a number of these cam and chain machines have been designed in an attempt to match a resistance variation through a range of motion with the natural strength curve for a particular muscle group associated with the range of motion. To the extent that these machines actually do succeed in approximating a resistance variation to an appropriate strength curve, an improvement over lifting of free weights probably has been achieved.

A number of exercise devices in the prior art allow the handles that the user grips to pivot freely while moving through the desired range of motion for the prescribed exercise. However, a supination or pronation movement in the hands and forearms is desirable in conjunction with the standard range of motion for a specified exercise because additional muscle groups are exercised. Heretofore exercise devices have not typically included a forced pronation or supination movement of the hands and arms occurring as the hands and arms are moved through the desired exercise range of motion.

SUMMARY OF THE INVENTION

In accordance with the present invention, therein is disclosed an exercise device with forced pronation or supination movement of the hand and arms in conjunction with the standard range of motion for a specified exercise. The device comprises a conventional frame and a centrally mounted seat. The seat is bisected by a vertical midplane that extends through the middle of the frame. The device has two sides that are mirror images with respect to the vertical midplane.

Pivotally attached to the frame is a sub-frame including a pair of levers. A "U" shaped member attached between the levers provides structural support and requires the levers to pivot in tandem about a first axis of rotation A1.

Movably attached to the distal end of each lever is a double "L" shaped handle. The handle incudes an elongated tubular grip section and a shorter cylindrical section attached 90° to the grip. The cylindrical section passes through an opening in the distal end of the lever, thereby allowing pivotal movement of the grip about a second axis of rotation A2.

A second leg of the double "L" shaped handle is attached at a 90° angle to the cylindrical section of the handle. A linkage rod is movably attached by means of a ball and socket connector to the distal end of the leg portion of the handle. The linkage rod is movably attached by means of a second ball and socket connector to the frame.

In operation, as force is applied by the exerciser to the handle, the lever of the sub-frame is pivoted forward about axis A1. As the lever pivots about axis A1, the handle is forced to pivot in a predetermined fixed relationship about axis A2. The hand and forearm of the exerciser undergoes a pronation or supination movement as the grip handle is pivoted about the axis A2 when the levers are pivoted about the axis A1. The hand and forearm also move down and in as the lever is pivoted.

In an alternate embodiment, a pair of miter gears are inserted in place of the linkage rod and ball and socket connectors. A stationary miter gear is located on a fixed axle and adjacent to the previously described lever. A hub is affixed to the proximal end of the lever oriented 90° to the fixed axle. A rolling miter gear is mounted on the hub such that the rolling miter gear is oriented 90° to the stationary miter gear. Attached to the rolling miter gear is a bracket. As the rolling gear rotates, the bracket pivots about the hub in an axis A4, in a plane perpendicular to the plane of axis A1.

The distal end of the bracket is pivotally connected to the first end of the connector rod, allowing for pivotal movement of the bracket about an axis of rotation A5 that is parallel to, but displaced from, axis A4.

In the second embodiment, the handle includes an elongated tubular grip section and a shorter cylindrical section attached at a 90° angle to the grip section, said cylindrical section passes through an opening in the distal end of the lever allowing for pivotal movement of the grip section about an axis of rotation A6.

Connected to the cylindrical section and perpendicular to the axis of the cylindrical section is a bracket. The distal end of the bracket is pivotally connected to the linkage rod. Pivotal movement of the linkage rod is allowed about axis A7 in a plane parallel to but displaced from the plane of pivotal movement of handle.

During operation of the second embodiment, as force is applied by the exerciser to the handle, the sub-frame is pivoted forward about axis A1. As the lever pivots about axis A1, the stationary gear forces the rolling gear to rotate. The bracket affixed to the rotating gear pivots about axis A4, perpendicular to axis A1, thereby forcing the linkage rod to pivot about axis A5. The linkage rod forces the bracket to rotate about axis A6, thereby pivoting the handle in a predetermined fixed relationship about axis A-6. The hands and forearms of the exerciser undergo a forced pronation or supination movement as the grip handle pivots about the axis A6 when the lever is pivoted about the axis A1.

BRIEF DESCRIPTION OF THE DRAWINGS

A more complete understanding of the present invention may be had by reference to the following Detailed Description when taken in conjunction with the accompanying drawings wherein.

DETAILED DESCRIPTION OF THE INVENTION

Figure 1:
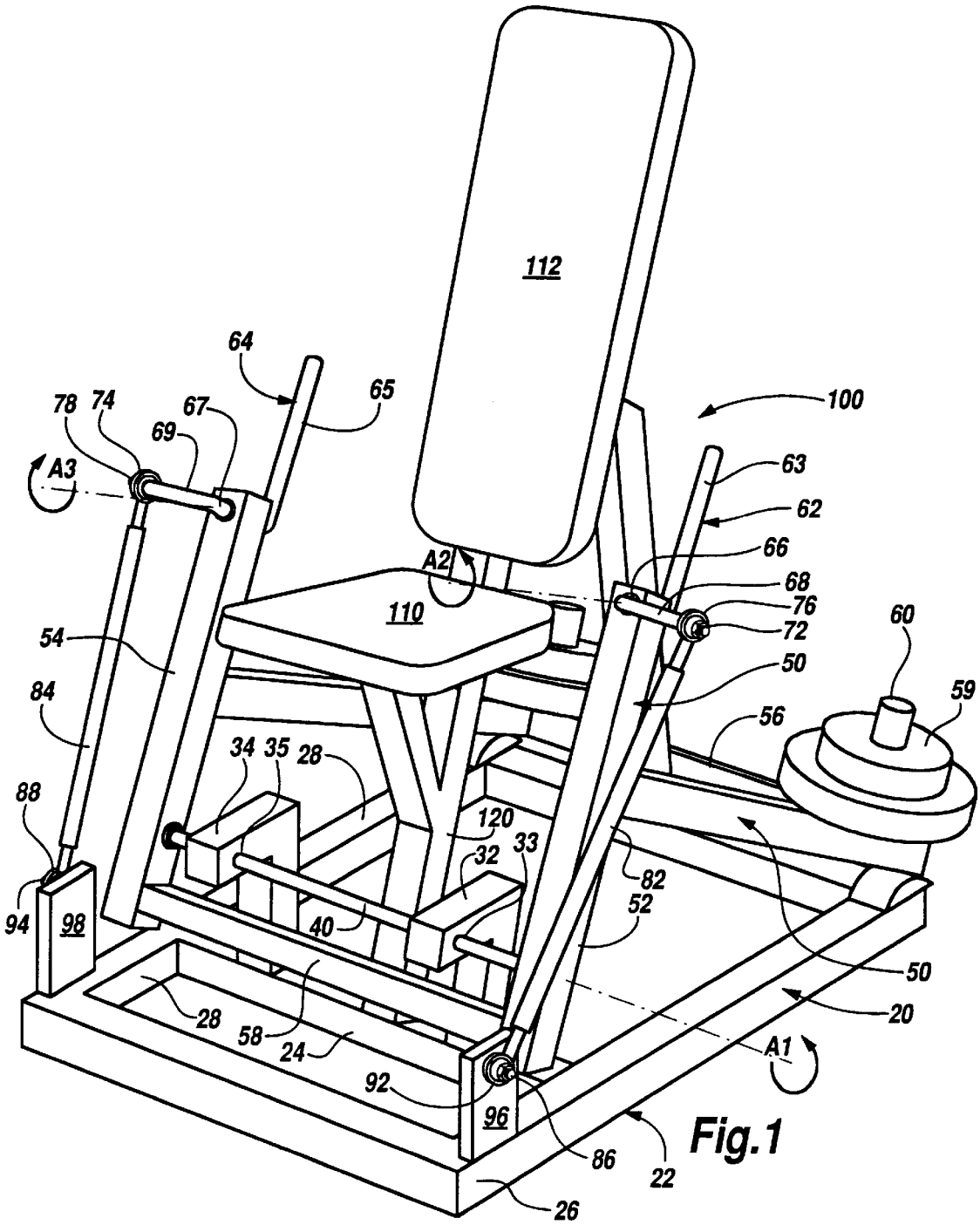
FIG. 1 is a perspective view of an exercise machine comprising the first embodiment of the present invention.

Reference is now made to the Drawings wherein like reference characters denote like or similar parts throughout the 14 FIGURES. Referring to FIG. 1, therein is illustrated an exercise device 100. A seat 110 and a back 112 are bisected by a vertical midplane that extends through the middle of a frame 20. The device 100 has two sides that are mirror images with respect to the vertical midplane.

The device 100 comprises a conventional frame 20 including a rectangular base 22 formed of standard metallic tubing, an intermediate cross brace 24 perpendicularly disposed between an opposing right member 26 and left member 28 of the rectangular base 22. A pair of "L" shaped supports 32 and 34 are rigidly fixed to the top of the cross brace 24. A rod 40 passes through openings 33 and 35 in the "L" shaped supports.

Figure 7:
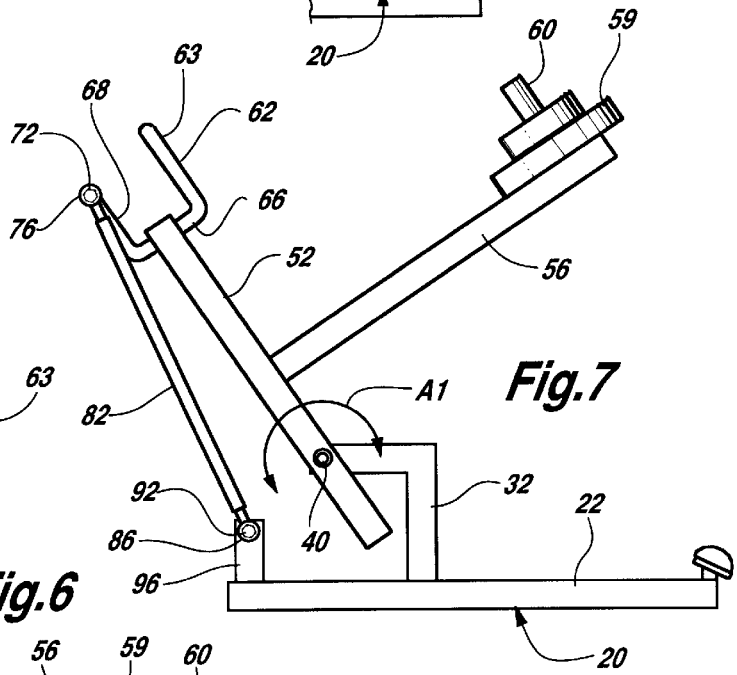
FIG. 7 is a partial side view of the exercise device of FIG. 1, illustrating a second position in the use thereof.
Figure 6:
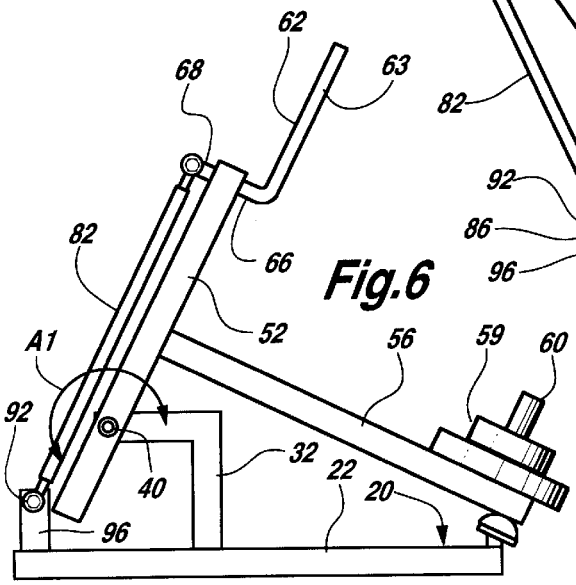
FIG. 6 is a partial side view of the exercise device of FIG. 1, illustrating a first position in the use thereof.

A movable sub-frame 50 includes a right lever 52 and a left lever 54, attached to opposite ends of the rod 40, thereby permitting pivotal movement of the levers 52 and 54 about a horizontal first axis of rotation A1. A "U" shaped member 56 attached between the levers 52 and 53 provides structural stability to the sub-frame 50 and requires the levers 52 and 54 to pivot in tandem about the first axis of rotation A1. A cross brace 58 further reinforces the rigidity and structural stability of the sub-frame 50. A cylindrical post 60 is affixed to the top of the "U" shaped member 56. Standard iron weights 59 may be stacked in increments around the post 60 to provide incremental mass for resisting pivotal movement about axis A1 (see also FIGS. 6 and 7).

Figure 4:
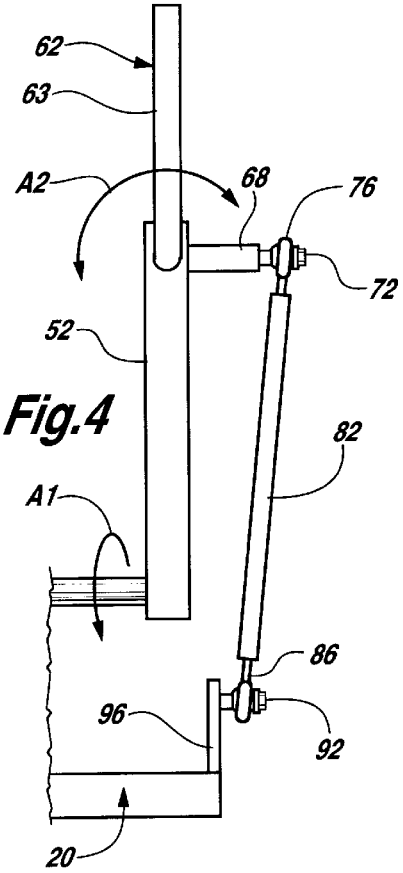
FIG. 4 is a partial rear view of the exercise device of FIG. 1, illustrating a first position in the use thereof.
Figure 5:
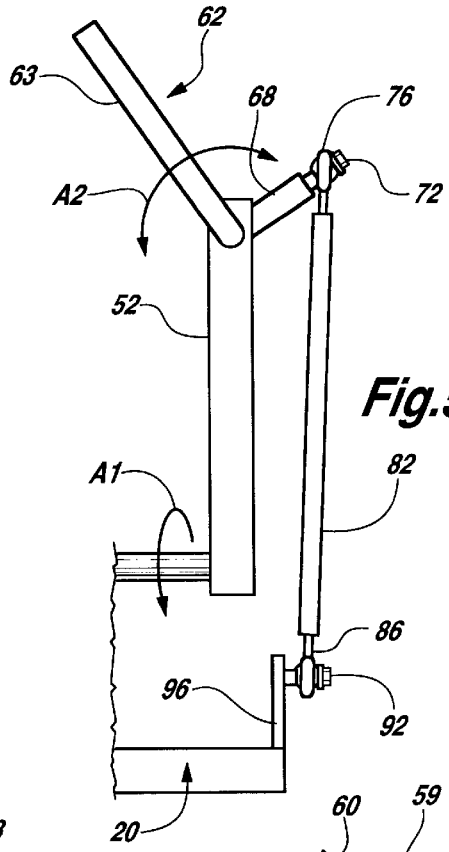
FIG. 5 is a partial rear view of the exercise device of FIG. 1, illustrating a second position in the use thereof.

Referring to FIGS. 4 and 5 in addition to FIG. 1, there is movably attached to the distal end of each lever 52 and 54 identical double "L" shaped handles 62 and 64. Although not shown in FIGS. 4–7, the lever 54 and the handle 64 and their associated components are mirror images of the lever 52 and the handle 62. The handle 62 includes an elongated tubular grip section 63 for grasping by the exerciser's hand. The handle 62 further includes a shorter cylindrical section 66 attached at a 90° angle to the grip section 63 and passing through an opening in the distal end of the lever 52, thereby allowing for pivotal movement of the grip 63 about a second axis of rotation A2. The companion handle 64 includes corresponding elements allowing for pivotal movement of grip 65 about a third axis A3.

The cylindrical section 66 is connected to a second leg 68 of the double "L" shaped handle 62. Similarly, companion double "L" shaped handle 64 includes a second leg 69 attached to cylindrical section 67.

The distal end of the leg 68 of the double "L" shaped handle 62 includes a first ball connector 72. A mating first socket connector 76 is attached to the first end of linkage rod 82. A second socket connector 86 is attached to the opposite end of the linkage rod 82. The socket connector 86 receives a ball connector 92 that is attached to a bracket 96 that is in turn rigidly attached to the base member 22 of the support frame 20. In like manner, the distal end of the leg 69 of the double "L" shaped handle 64 includes a first ball connector 74. A mating first socket connector 78 is attached to the first end of the linkage rod 84. A second socket connector 88 is attached to the opposite end of linkage rod 84. The second socket connector 88 receives a ball connector 94 that is in turn attached to a bracket 98 that is rigidly attached to the base member 28 of the support frame 20. The seat 110 and the back 112 are attached to a support 120 that is in turn rigidly attached to the cross support 24 of the frame 20. The seat 110 and the back 112 are positioned between the grip handles 62 and 64 and the levers 52 and 54.

Figure 3:
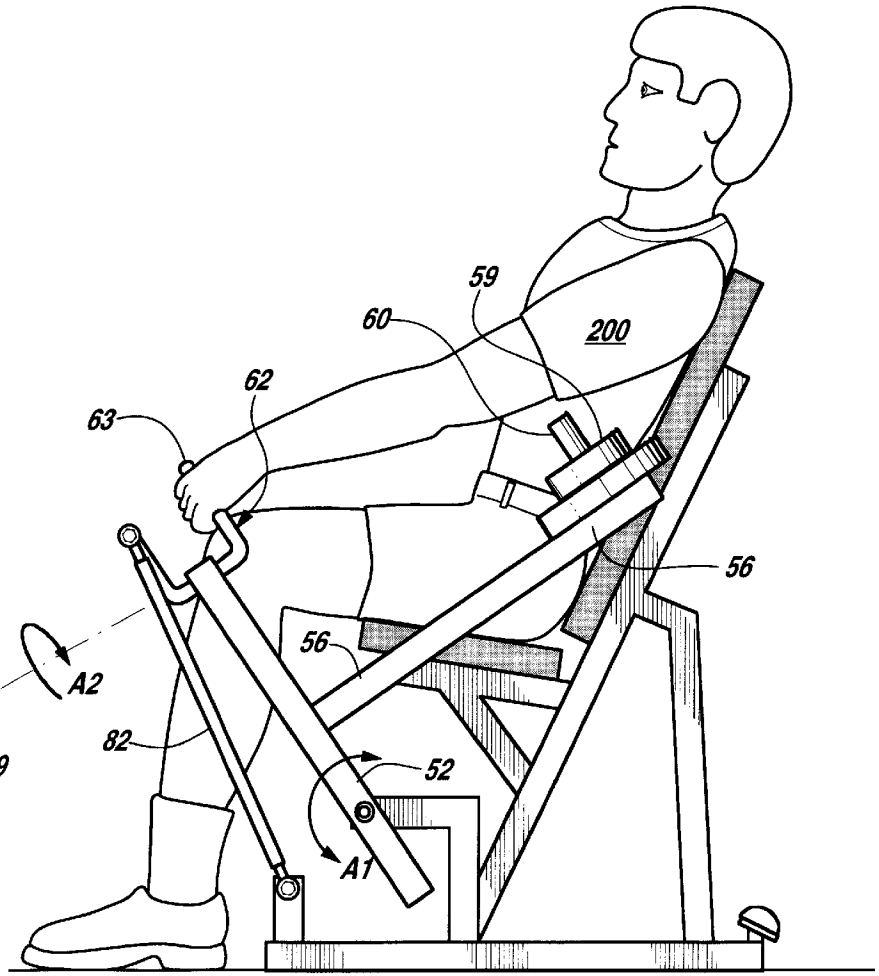
FIG. 3 is a side view of the exercise device of FIG. 1, illustrating a second position in the use thereof.
Figure 2:
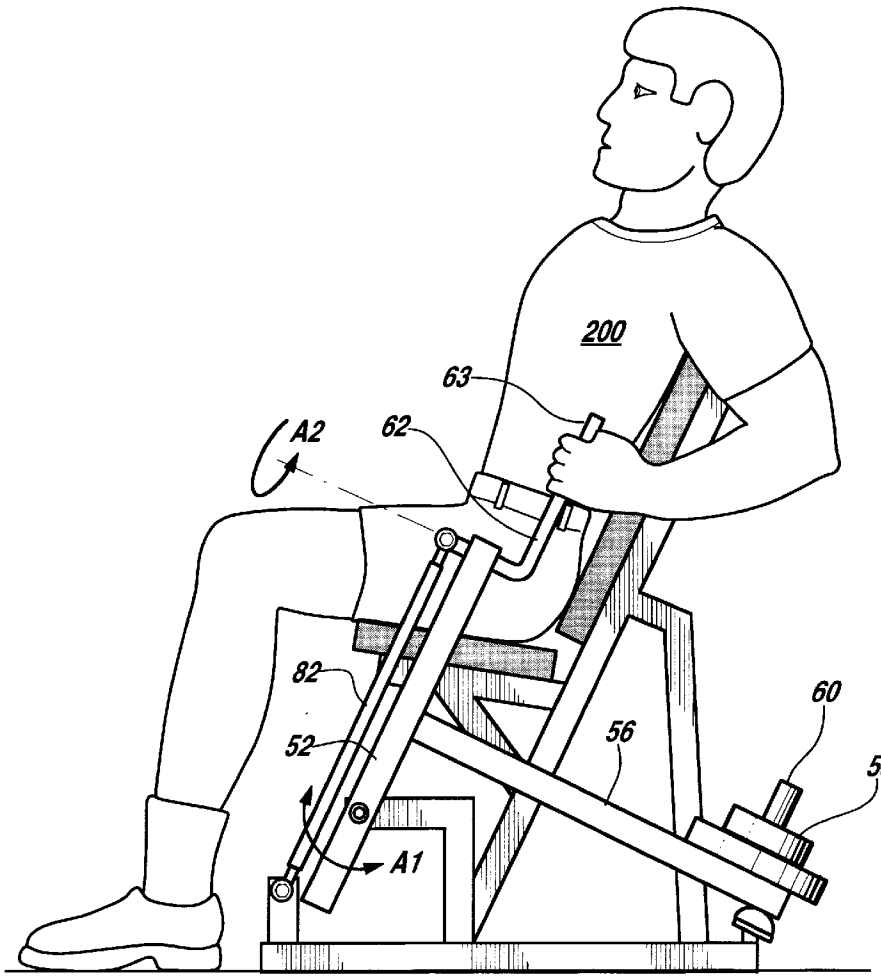
FIG. 2 is a side view of the exercise device of FIG. 1, illustrating a first position in the use thereof.

Referring to FIGS. 2 and 3, in operation, as force is applied by the exerciser 200 to the handle 62 and companion handle 64 (not shown), the lever 52 of the sub-frame 50 is pivoted forward about axis A1. Resistance to forward movement is provided by the mass of the weight stack 59. As is illustrated in FIGS. 3 through 7, as the lever 52 pivots about axis A1, the handle 62 is forced to pivot in a predetermined fixed relationship about axis A-2. The hands and forearms of the exerciser 200 undergo a pronation or supination movement as the grip handles 52 and 54 are pivoted about the axis A2 and A3 when the levers are pivoted about the axis A1. The hands and forearms also move down and in as the levers are pivoted.

Referring now to FIGS. 8–11 therein is illustrated an alternate embodiment 180 wherein a pair of miter gears 186 and 188 are inserted in place of the linkage rod 82 and the connectors 72, 74, 76, 78, 86, 88, 92 and 94 of FIGS. 4–7. The below described elements designated by (') reference numerals replace those like numbered elements illustrated in FIG. 1–3 without the (') designation.

Figure 8:
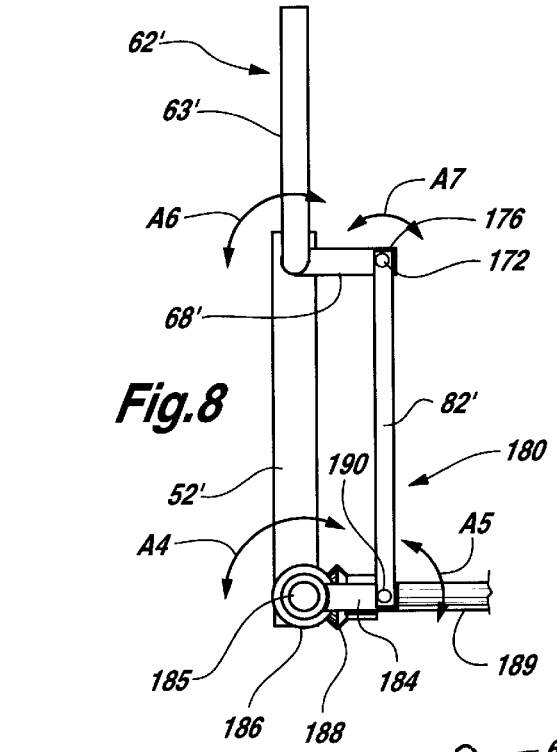
FIG. 8 is a partial rear view of a second embodiment of the exercise device of the present invention, illustrating a first position in the use thereof.
Figure 9:
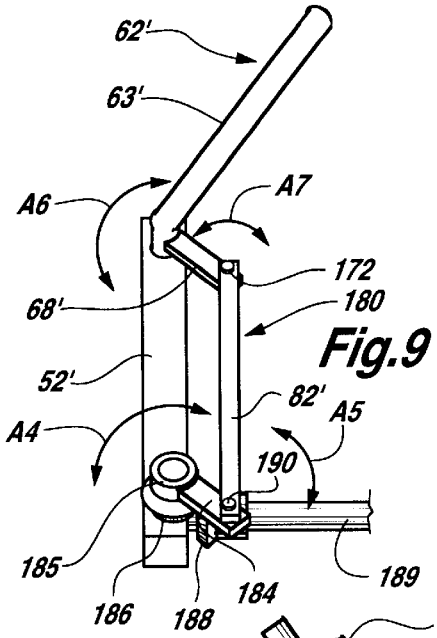
FIG. 9 is a partial rear view of the exercise device of FIG. 8 illustrating a second position in the use thereof.
Figure 11:
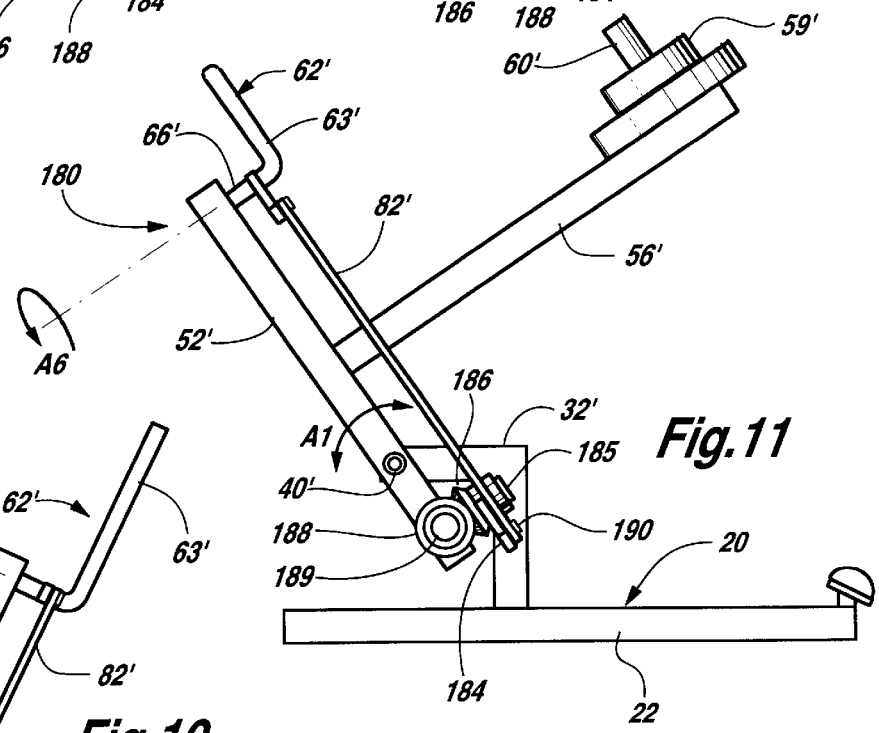
FIG. 11 is a partial side view of the exercise device of FIG. 8 illustrating a second position in the use thereof.
Figure 10:
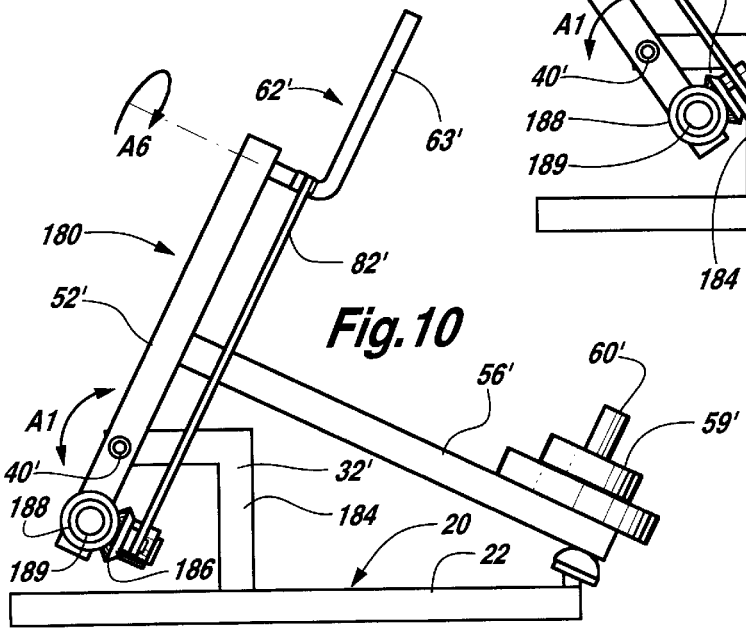
FIG. 10 is a partial side view of the exercise device of FIG. 8 illustrating a first position in the use thereof.

Referring to FIGS. 8 and 9 in addition to FIGS. 1–3, a pair of identical "L" shaped handles 62' and 64' (not shown) are movably attached to the distal ends of a lever 52' and a lever 54' (not shown). Although not shown in FIGS. 8–11, the lever 54' and the handle 64' and their associated components are mirror images of the lever 52' and the handle 62'.

Extending between the proximal end of the lever 52' and the lever 54' is a fixed axle 189. Located on the fixed axle 189 and adjacent to the lever 52' is a stationary miter gear 188. A hub 185 is affixed to the proximal end of the lever 52' oriented 90° to the fixed axle 189. A rolling miter gear 186 is mounted on the hub 185 such that the rolling miter gear 186 is oriented 90° to the stationary miter gear 188. The stationary miter gear 188 and the rolling miter gear 186 include a 20° miter on their face and are commercially available from the Martin Company of Arlington, Texas. Attached to the rolling miter gear 186 is a bracket 184. As the rolling gear 186 rotates, the bracket 184 pivots about the hub 185 in an axis A4, in a plane perpendicular to the plane of axis A1.

A standard connector pin 190 connects the distal end of the bracket 184 with the first end of the connector rod 82', allowing pivotal movement of the bracket 184 about an axis of rotation A5 that is parallel to, but displaced from axis A4.

The handle 62' includes an elongated tubular grip section 63' for grasping with a hand. The handle 62' further includes a shorter cylindrical section 66' attached at a 90° angle to the grip section 63' and passing through an opening in the distal end of the lever 52' allowing for pivotal movement of the grip section 63' about an axis of rotation A6.

Connected to the cylindrical section 66', and perpendicular to the axis of the cylindrical section 66', is a bracket 68'. The distal end of the bracket 68' includes a standard pin connector 172 received in an opening 176 in linkage rod 82'. Pivotal movement of the linkage rod 82' is allowed about axis A7 in a plane parallel to, but displaced from, the plane of pivotal movement of handle 63'.

During operation of the second embodiment, as force is applied by the exerciser to the handle 62' and the companion handle 64' (not shown), the levers 52' and 54' of the sub-frame 50' are pivoted forward about axis A1. Resistance to forward movement is provided by the mass of the weight stack 59'. As is illustrated in FIGS. 8–11, as the lever 52' pivots about axis A1, the stationary gear 188 rotates rolling gear 186. The bracket 184 affixed to the gear 186 pivots about axis A4, perpendicular to axis A1 thereby forcing the linkage rod 82' to pivot about axis A5. The linkage rod 82' forces the bracket 68' to rotate about axis A6, thereby pivoting the handle 62' in a predetermined fixed relationship about axis A-6. The hands and forearms of the exerciser undergo a forced pronation or supination movement as the grip handle 62' pivots about the axis A6 when the lever 52' is pivoted about the axis A1.

Figures 12, 13, 14:
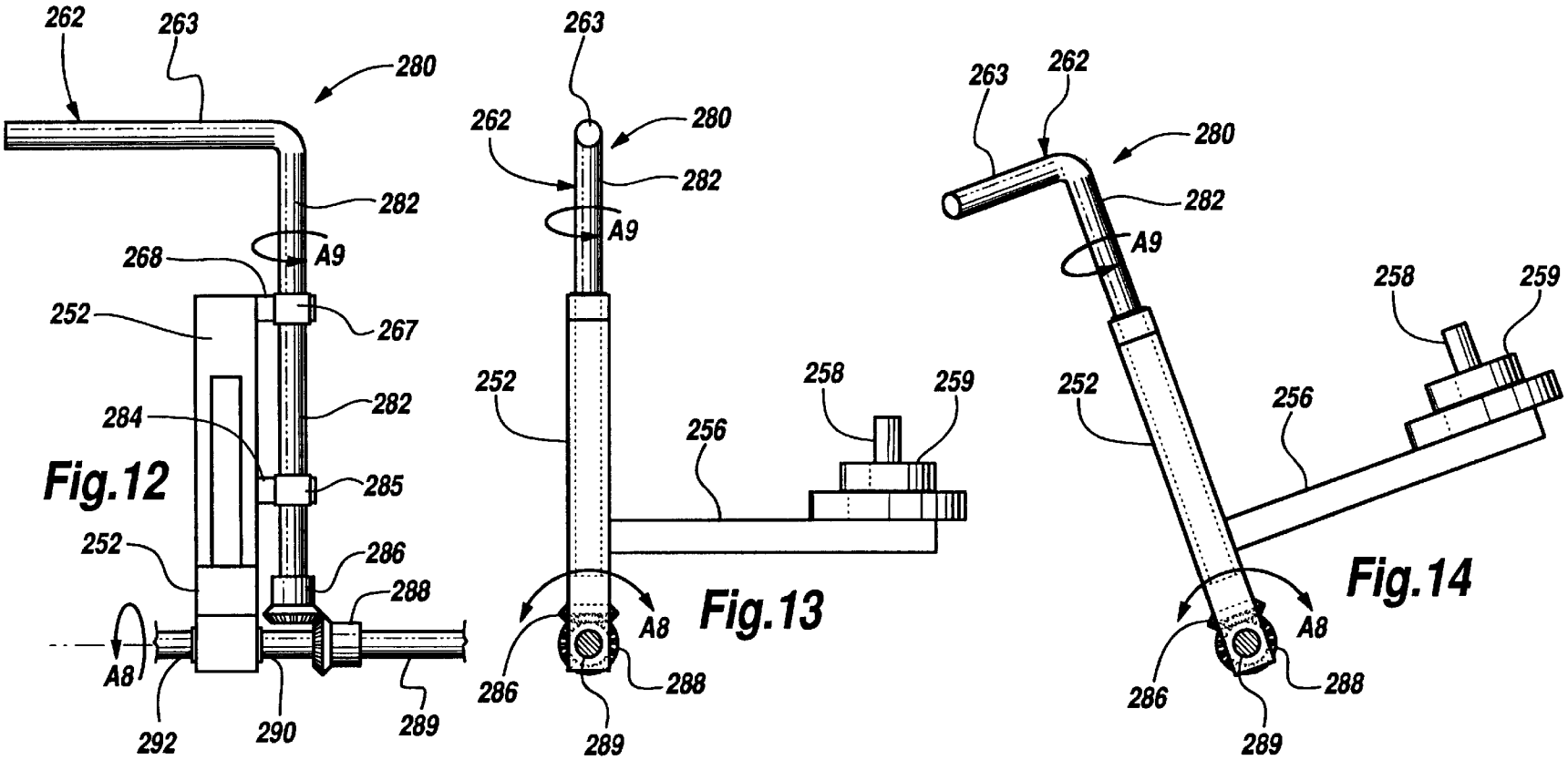
FIG. 12 is a partial front view of a third embodiment of the exercise device of the present invention illustrating a first position in the use thereof.
FIG. 13 is a partial side view of the exercise device of FIG. 12 illustrating a first position in the use thereof.
FIG. 14 is a partial side view of the exercise device of FIG. 12 illustrating a second position in the use thereof.

Referring now to FIGS. 12–14 therein is illustrated a third embodiment 280 of the present invention that provides for a modified hand and arm motion occurring as the hands and arms moved through the desired exercise range of motion. An "L" shaped handle 262 is movably attached to a lever 252 by means of brackets 268 and 284 and bearings 267 and 285. The handle 262 includes an elongated tubular grip section 263 for grasping with a hand. The handle 262 further includes a leg section 282 attached at a 90° angle to the grip section 263, said leg section 282 is disposed through the bearings 267 and 285 of brackets 268 and 284 providing for pivoting movement of the grip section 263 about an axis of rotation A9.

On the proximal end of the lever 252 is a cylindrical opening containing a pair of bearings 290 and 292. The lever 252 is pivotally mounted on a fixed axle 289 that passes through the bearings 290 and 292, thereby providing for a pivoting movement about an axis A8.

A rolling miter gear 286 is fixably mounted on the leg section 282 of the handle 262. Located on the fixed axle 289 and adjacent to the lever 252 is a stationary miter gear 288. The rolling miter gear 286 is oriented 90° to the stationary miter gear 288. The stationary miter gear 288 and the rolling miter gear 286 include 20° pressure angle gear teeth with a 45° bevel angle and are commercially available from the Martin Company of Arlington, Tex. Cylindrical post 258 is affixed to the top of member 256, which extends from lever 252. Standard iron weights 259 may be stacked in increments around post 258 to provide incremental mass for resisting pivotal movement about axis A8.

During operation of the third embodiment, as force is applied by the exerciser 200 to the handle 262, the lever 252 is pivoted forward about axis A8. Resistance to forward movement is provided by the mass of the weight stack 259. As is illustrated in FIGS. 12–14, as the lever 252 pivots about axis A8, the stationary gear 288 forces rolling gear 286 to rotate about axis A9. The leg section 282 affixed to rolling gear 286 rotates with gear 286 thereby pivoting the grip handle 263 in a predetermined fixed relationship about the axis A9, perpendicular to axis A8. The hands and arms of the exerciser 200 undergo a forced movement as the grip handle 262 pivots about the axis A9 when the lever 252 is pivoted about the axis A8.

It is to be understood that the elements of the above-described invention used to create a forced pronation or supination movement may be used in any number of configurations for exercise machines including but not limited to push or pull motions in bench press machines, rowing machines, pull down machines and decline press machines. Although the preferred and alternative embodiments of the invention have been illustrated in the accompanying Drawings and described in the foregoing Detailed Description, it will be understood that the invention is not limited to the embodiment disclosed but is capable of numerous modifications without departing from the scope of the invention as claimed.

I claim:

1. An exercise device comprising;

a frame including a first axis;

at least one lever having first and second ends;

means supporting the lever, at the first end thereof, on the frame for pivotal movement about the first axis;

means operatively connected to the lever for resisting pivotal movement of the lever about the first axis;

a handle;

means supporting the handle on the lever, at the second end thereof, for pivotal movement about a second axis substantially perpendicular to the first axis; and means for pivoting the handle about the second axis in a predetermined relationship relative to the lever when the lever is pivoted about the first axis.

2. The exercise device of claim 1 wherein the means for pivoting the handle about the second axis in a predetermined relationship relative to the lever as the lever is pivoted about the first axis comprises:

a linkage rod having first and second ends;

a first socket connector attached to the handle;

a first ball connector received in the first socket connector and attached to the first end of the linkage rod;

a second socket connector attached to the frame of the exercise device; and a second ball connector received in the second socket connector and attached to the second end of the linkage rod.

3. The exercise device of claim 1 wherein means for pivoting the handle about the second axis in a predetermined relationship relative to the lever as the lever is pivoted about the first axis comprises:

a stationary miter gear attached to the frame of the exercise device;

a rolling miter gear engaging the stationary miter gear, said rolling miter gear mounted on, and pivotal with respect to the lever, proximate the first end thereof, said rolling gear having an axis of rotation intersecting the first axis;

at least one bracket supporting the rolling miter gear for pivotal movement; and means for connecting the rolling miter gear to the handle so that said handle rotates with said rolling miter gear.

4. The exercise device of claim 1 wherein means operatively connected to the lever for resisting pivotal movement of the lever about the first axis in at least one direction comprises:

at least one weight removably attached to the lever.

5. The exercise device of claim 1 wherein means supporting the lever on the frame for pivotal movement about the first axis comprises:

at least one bracket having a hole therein, said hole being aligned with the first axis; and an axle passing through the hole in the at least one bracket, so as to be rotatable about the first axis, with the lever mounted on said axle.

6. The exercise device of claim 1 wherein the means for pivoting the handle about the second axis in a predetermined relationship relative to the lever as the lever is pivoted about the first axis comprises:

a linkage rod having first and second ends;

the handle including a first pin receiving connector;

a first pin connection attached to the first end of the linkage rod and received in the first pin receiving connector;

the frame of the exercise device including a second pin receiving connector; and a second pin connection attached to the second end of the linkage rod and received in the second pin receiving connector.

7. An exercise device for producing forced pronation and supination movements in the hands of the user, said device comprising;

a frame including a horizontal first axis;

a sub-frame that pivots about the first axis said sub-frame including:

at least one lever having first and second ends, the first end being proximate the first axis;

means operatively connected to the sub-frame for resisting pivotal movement of the lever about the first axis;

a handle connected to the lever, at the second end thereof, for pivotal movement about a second axis substantially perpendicular to the first axis; and means for pivoting the handle about the second axis in a predetermined relationship relative to the lever as the lever is pivoted about the first axis.

8. The exercise device of claim 7 wherein the means for pivoting the handle about the second axis in a predetermined relationship relative to the lever as the lever is pivoted about the first axis comprises:

a linkage rod having first and second ends;

a first socket connector attached to the handle;

a first ball connector received in the first socket connector and attached to the first end of the linkage rod;

a second socket connector attached to the frame of the exercise device; and a second ball connector received in the second socket connector and attached to the second end of the linkage rod.

9. The exercise device of claim 7 wherein means for pivoting the handle about the second axis in a predetermined relationship relative to the lever as the lever is pivoted about the first axis comprises:

a stationary miter gear attached to the frame of the exercise device;

a rolling miter gear engaging the stationary miter gear, said rolling miter gear mounted on, and pivotal with respect to the lever, proximate the first end thereof, said rolling gear having an axis of rotation intersecting the first axis;

at least one bracket supporting the rolling miter gear for pivotal movement; and means for connecting the rolling miter gear to the handle so that said handle rotates with said rolling miter gear.

10. The exercise device of claim 7 wherein means operatively connected to the lever for resisting pivotal movement of the lever:

one or more weights removably attached to the subframe.

11. The exercise device of claim 7 wherein the means for pivoting the handle about the second axis in a predetermined relationship relative to the lever as the lever is pivoted about the first axis comprises:

a linkage rod having first and second ends;

the handle including a first pin receiving connector;

a first pin connection attached to the first end of the linkage rod and received in the first pin receiving connector;

the frame of the exercise device including a second pin receiving connector; and a second pin connection attached to the second end of the linkage rod and received in the second pin receiving connector.

12. A method for forcing a pronation or supination movement of the hand in combination with forearm movement relative to the upper arm in an exercise routine comprising the steps of:

providing a lever having a length that is substantially perpendicular to, and is pivotally mounted to rotate about a first axis, the lever having a handgrip pivotally mounted thereto to rotate about a second axis substantially perpendicular to the first axis;

providing a selected resistance to rotation of the lever about the first axis;

gripping the handgrip with the hand so that the forearm is substantially parallel to the second axis, the handgrip having a longitudinal axis substantially perpendicular to the forearm, to rotate the lever about the first axis and;

rotating the lever about the first axis and pivoting the handgrip about the second axis in a predetermined relationship relative to the lever, so that the gripping hand is caused to pronate as the lever rotates in one direction and supinate as the lever rotates in the opposite direction about the first axis.

* * * * *